United States Patent [19]

Deike

[11] 4,286,747

[45] Sep. 1, 1981

[54] MAIL BOX SUPPORT

[75] Inventor: Robert F. Deike, Cheyenne, Wyo.

[73] Assignee: Foresight Industries, Cheyenne, Wyo.

[21] Appl. No.: 113,025

[22] Filed: Jan. 17, 1980

[51] Int. Cl.[3] ..... B65D 91/00

[52] U.S. Cl. ..... 232/39; 52/156

[58] Field of Search ..... 232/17, 38, 39; 248/156, 145, 146, 548, 158; 52/166, 98

[56] References Cited

U.S. PATENT DOCUMENTS

| | | | |
|---|---|---|---|
| 2,746,208 | 5/1956 | Lewis | 248/145 X |
| 3,020,798 | 2/1962 | Chrisman | 248/145 X |
| 3,127,870 | 4/1964 | Bieber | 248/548 |
| 3,342,444 | 9/1967 | Nelson | 248/156 X |
| 3,497,078 | 2/1970 | Nash | 232/39 |
| 3,797,182 | 3/1974 | Eichstaedt | 52/156 |
| 3,969,853 | 7/1976 | Deike | 52/156 |
| 4,021,977 | 5/1977 | Deike | 52/98 |
| 4,164,907 | 8/1979 | Piatscheck | 109/50 |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

An energy absorbing support for mailboxes and the like devices mounted alongside roadways where they are exposed to impact by vehicles has a post of generally reverse "C" shape with a depending upright leg secured in the socket of an anchor driven in the ground, an upwardly inclined generally horizontal lateral leg portion, an outwardly sloping generally vertical leg portion extending from the outer end of the lateral portion, and a reverse horizontal top leg portion overlying the lateral leg portion and having mountings thereon carrying mailboxes and the like. The depending leg portion is vertically adjustable in the socket of the ground anchor so that the upper end of the lateral leg portion and the lower end of the sloping vertical leg portion will be at a height above ground level within the range of the height of an automobile front bumper to receive initial impact of a vehicle crashing into the support. The socket anchor mounts the support parallel with the roadway and projecting towards oncoming traffic in the adjacent road lane so that any initial impact from a vehicle will bend and rotate the upright leg causing the support to tilt under the vehicle and prevent any portion thereof or any mailboxes carried thereby from crashing into the occupied area of the vehicle. The support can be extended by a complementary identically "C" shaped post secured to the depending upright leg and the free end of the top horizontal leg of the main post presenting a closed loop configuration lying in a flat plane. Mailboxes of the like are attached to the horizontal top legs of both posts. The posts can be composed of metal tubing with the upright leg portion having a weakened fracture zone just above the ground anchor. Mounting brackets carried by the horizontal leg of the post attach mailboxes and the like thereto and shear type attachments can be used to allow the boxes to leave the post upon severe impact.

12 Claims, 11 Drawing Figures

MAIL BOX SUPPORT

BACKGROUND OF THE INVENTION

1. Field of the Invention

This invention relates to the art of improving the safety of roadside mounted devices such as mailboxes and particularly relates to an energy absorbing stand or support system for mailboxes.

2. Description of Prior Art

Heretofore mailbox supports mounted alongside roadways have been overlooked as potential traffic hazards and have caused many fatalities by permitting the support structure and the mailboxes to enter the occupied zone of a vehicle impacting the support or mailboxes carried thereby. Multiple mailbox supports have conventionally been in the form of an upright post mounted in the ground and carrying a horizontal leg or arm carrying the mailboxes at a level conveniently reached from the driver's seat of the mail car or delivery vehicle. When such structures are impacted by an oncoming vehicle the arm carrying the mailboxes is high enough to penetrate the occupied area of the vehicle causing injury to the occupants. It would be an improvement in the art to provide a mailbox support system which would yield upon impact by a vehicle bumper to underlie the vehicle and prevent any portion thereof from entering the occupied area of the vehicle.

SUMMARY OF THE INVENTION

According to the this invention there is provided a support system for mailboxes and the like devices conventionally mounted along roadways which will yield under impact from an oncoming vehicle in such a manner that none of the structure or devices carried thereby can enter the occupied area of the vehicle.

The supports of this invention have a post such as a tube bent into inverted C-shape with a depending upright leg at the bottom thereof adjustably wedge-locked in a ground anchor that is driven in the ground and presents a socket below ground level receiving the leg. The upper end of this leg is bent laterally along an upwardly inclined horizontal leg portion the outer end of which is bent upwardly to slope vertically upwardly and outwardly and to face oncoming traffic. The top end of the sloping vertical portion is then bent backward forming a horizontal top leg on which mailboxes or the like are mounted. A generally reverse C-shaped post with a depending upright leg, an inclined lateral leg, an inclined side leg and a reverse horizontal top leg is thus provided. Structurally this post can be in the form of a metal tube or pipe of round, oval or square configuration or can be a rod, metal strip or the like bent to the safety contour provided by this invention.

To increase the carrying capacity of the post, a complementary reverse C-shaped post is provided with its depending leg secured to the leg of the main contoured post and with its top horizontal arm secured to and mated with the top arm of this main post.

A weakened fracture zone is provided by perforations or the like in the depending upright leg of the main support post positioned at a level just above the anchor when the post is in place in the socket.

The mailboxes or the like devices are affixed on top of the horizontal leg of the post by angle strips straddling and bolted to the top leg and having horizontal legs attached to the mailbox base or to a mounting plate on the bottom of the mailbox through shear pins, bolts or other connections which will permit the boxes to separate from the post under high impact.

The depending or upright leg portion of the post is vertically adjustable in the socket of the ground anchor to position the sloping laterally extending and the sloping vertical leg portions of the post at a level above the ground within the range of the height of an automobile front bumper to receive the initial impact from an oncoming vehicle. The heights and angles of the leg portions are controlled so that no portion of the support post or the mailboxes or other devices carried thereby can enter the occupied area of a vehicle crashing into the support. The automobile bumper will initially crush the area of the post adjacent the juncture between the laterally extending leg portion and the upwardly sloping leg portion. Then the continued force of the oncoming vehicle will bend the depending or upright bottom leg portion and will also cause it to rotate in the socket of the ground anchor so that as the vehicle progresses it will roll over the support and the mailboxes preventing any portion thereof from penetrating the passenger compartment of a vehicle. The weakened fracture zone of the upright or bottom leg portion accommodates the bending and eventually may accommodate breaking the support away from the socket but not until the structure has been overlapped by the vehicle.

It is therefore a feature of this invention to provide a safety support system for mailboxes and the like devices conventionally mounted alongside roadways which when impacted by a vehicle will yield to bend and rotate under the vehicle. Devices carried by the support of this invention may be at levels accessible from the passenger compartment of the vehicle but when the device is impacted by the vehicle, all of the structure folds down under the vehicle.

In a preferred embodiment the depending bottom leg portion of the contoured post is about two feet in length with about one and a half feet inserted in the socket of the ground anchor and with about six inches projecting above ground. This provides a six inch height adjustment. The laterally projecting sloping generally horizontal-leg portion is at an angle of about 15 degrees from the horizontal and the upwardly and outwardly sloping leg portion of the post is at an angle of about 70 degrees from the horizontal. This provides an area of average bumper contact which is about 20 inches above ground level. The top horizontal leg portion of the post is about 40 inches above ground level. This top horizontal leg portion can receive two or more mailboxes and has a length of about 25 to 30 inches. The complementary post to extend the mailbox support length for accommodating two or more additional mailboxes has the same configuration and dimensions but its depending bottom leg is shorter since it does not penetrate the ground and is bolted to the leg of the main post. A simple coupling arrangement joins the top horizontal legs of the main post and the complementary post.

The mailboxes are firmly mounted on the top horizontal legs of light gauge strips having vertical legs embracing the front and rear faces of the horizontal post leg and secured therethrough by through bolts and with the horizontal legs projecting outwardly receiving the bottom of the mailbox or a base support for the mailbox.

Reflectorized tape can be wound around the post at a convenient level for visibility.

The ground anchor is preferably an angle iron leg member with a bent sheet metal strip or ribbon forming fins or flukes radiating from the top end of the leg and cooperating therewith to define the socket. The bottom leg of the post fits in the socket and is clamped against the angle iron leg of the anchor by a wedge driven in the chamber provided by the fin defining strip. This arrangement securely clamps the bottom leg of the support post in an upright position but under severe stress the post leg can rotate and even be pulled out of the socket.

It is then an object of this invention to provide an energy absorbing support system for devices mounted along roadways.

Another object of this invention is to provide a mailbox support structure which will yield under impact and bend to the ground underneath an oncoming vehicle to protect the occupied area of the vehicle.

A specific object of this invention is to provide a mailbox post of reverse C-shaped configuration with a depending leg portion mounted in the socket of a ground anchor and adapted to fracture and rotate upon impact.

Another specific object of the invention is to provide a mailbox post and a ground anchor therefore which will permit vertical adjustment of the height of the leg portions of the post to present inclined leg portions at vehicle bumper level that will crush on initial impact to be trapped underneath the vehicle preventing entry into the passenger compartment of the vehicle.

Other and further objects of this invention will become apparent to those skilled in this art from the following detailed description of the annexed sheets of drawings which, by way of preferred embodiments only, illustrate several modifications of the invention.

DETAILED DESCRIPTION OF THE PREFERRED EMBODIMENTS

Figure 1:
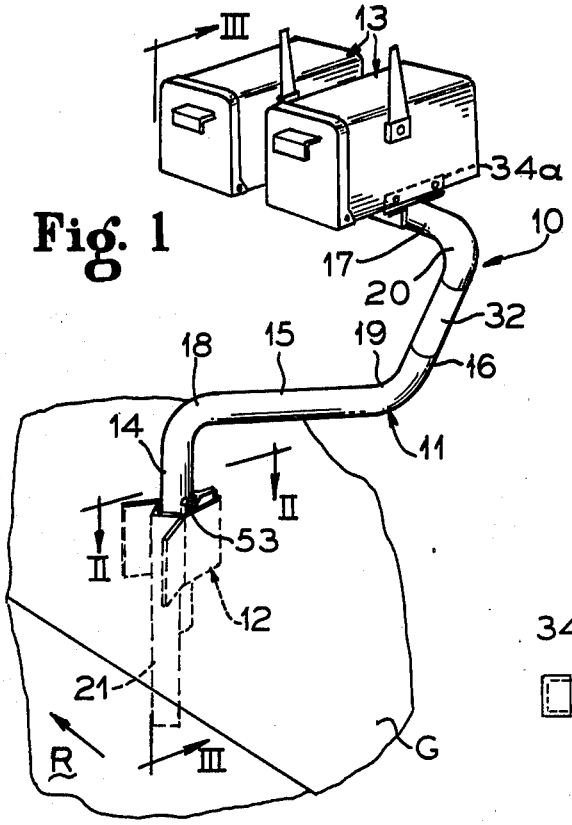
FIG. 1 is a perspective view of a mailbox support system of this invention mounted alongside a roadway.

In FIG. 1 the mailbox support system 10 of this invention is illustrated as including a bent tubular post 11 of generally inverted C-shape with a depending upstanding leg portion mounted in a ground anchor 12 driven in the ground G alongside a roadway R. Mailboxes 13 are mounted on top of the post.

Figure 3:
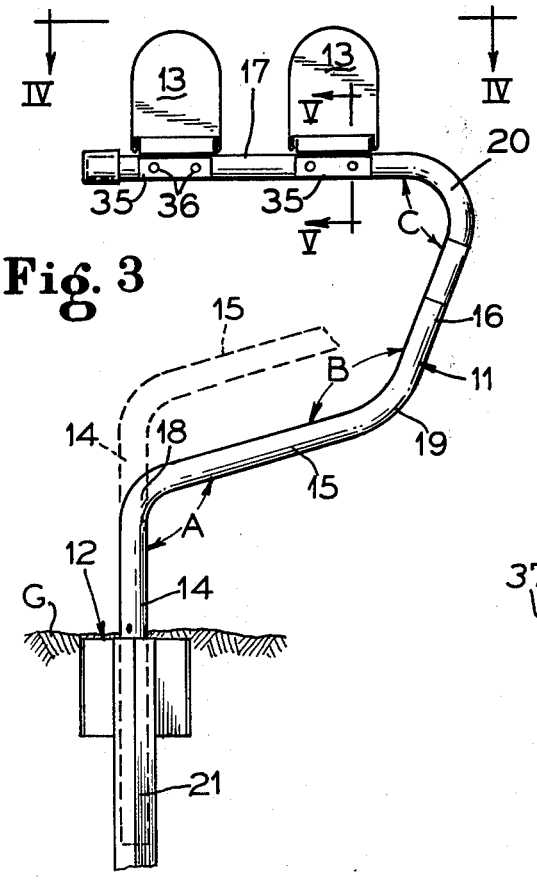
FIG. 3 is a longitudinal sectional view with parts in elevation, taken along the line III—III of FIG. 1.

The post 11, as also shown in FIG. 3, has an upstanding vertical leg 14 at the bottom thereof anchored in and extending above the ground anchor 12, a laterally extending generally horizontal but upwardly inclined leg 15 bent from the leg 14 in a direction facing oncoming traffic on the roadway R as shown by the arrow in FIG. 1. This laterally extending leg 15 is then bent upwardly and outwardly forming a generally vertical but outwardly sloped leg 16. The upper end of the leg 16 is bent rearwardly forming a top horizontal leg 17 on which the mailboxes 13 are mounted. Gently curved large radial bends 18, 19 and 20 smoothly merge the legs 14, 15, 16 and 17. The bend 18 provides an external obtuse angle "A" of about 105 to 130 degrees so that the leg 15 will slope upwardly from the horizontal at about 15 to 30 degrees. The bend 19 provides an internal obtuse angle "B" of about 105 to 130 degrees thereby also sloping the leg 16 about 15 to 30 degrees from the vertical. The bend 20 provides an internal acute angle C of about 60 to 75 degrees so that the leg 17 will be horizontal and parallel with the ground G.

In a preferred mailbox post 11, the bottom vertical leg 14 is about two feet long, the laterally inclined leg 15 is about 30 inches long, the inclined vertical leg 16 is about 20 inches long, and the top horizontal leg is about 28 inches long. With such dimensions, when the leg 14 is projected for about half its length above ground level, the top horizontal leg 17 will be about 40 inches above ground level affording a convenient height for access to the mailboxes 13 either by a person standing on the ground G or seated in the driver's seat of a vehicle. These dimensions will also position the bend 19 just below the height of a front bumper of an automobile so that initial impact of such a bumper will occur against the leg 16 just above the bend 19.

The radii of curvature of the bends 18, 19 and 20 is of the order of 3 to 6 inches so that, as explained above, gentle curves will connect the leg portions of the post 11.

As illustrated, the post 11 is a metal tube. It may vary in diameter from 1½ to 3 inches with a metal gauge of from 12 to 16. Mild tube steel is satisfactory for forming the post.

Figure 2:
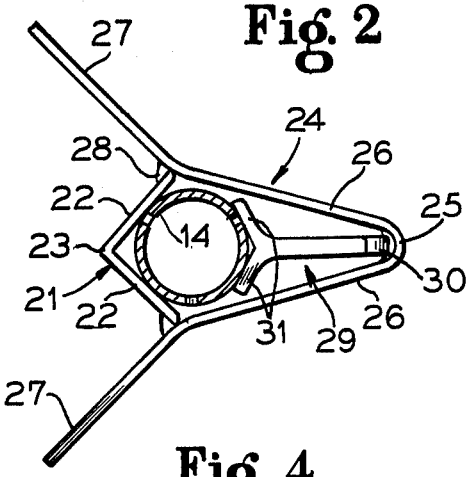
FIG. 2 is a transverse cross-sectional view along the line II—II of FIG. 1.

The ground anchor 12 is of the type disclosed and claimed in my co-pending application Ser. No. 104,291, filed Dec. 17, 1979 and as shown in FIG. 1 to 3 has an angle iron leg 21 with sidewalls 22, 22 extending from a right angle corner 23. A bent metal strip or ribbon 24 embraces the upper end of the leg 21 and radiates therefrom to form fins or flukes. As shown in FIG. 2, this strip 24 is bent midway of its length to form a crease 25 and diverging side legs 26, 26 which embrace the outer end edges of the walls 22, 22 of the angle iron 21 and are then bent outwardly forming divergent legs 27, 27 extending to free end edges beyond the outer face of the angle iron 21. Weld bonds 28 unites the legs 26, 26 with the end edges of the angle iron sidewalls 22. A V-wing socket or chamber 29 is thus formed at the upper end of the leg 21 receiving the bottom leg portion 14 of the post 11. A wedge plate or slab 30 is inserted in this chamber 29 and bottomed on the crease 25 with diverging feet 31 spanning the leg portion 14 and clamping the post against the anchor leg 21. The leg 21 is driven into the ground G to submerge the fins formed by the strip 24 with the socket chamber 29 being open at the top to receive the bottom leg portion 14 of the post 11. The leg 24 may be relatively short since the fins will stabilize it against tilting in the ground G. Leg lengths of from 18 to 30 inches are sufficient. The width of the strip 24 is preferably about 5 to 8 inches to afford substantial fin areas engaging the surrounding ground.

The leg 14 of the post is dropped through the socket 29 to a desired depth for positioning the top horizontal leg portion 17 at the desired height and then the wedge 30 is driven in the socket to clamp the post in fixed upright position relative to the ground. The post 11 is positioned in the ground anchor 12 to be parallel with the road R and to present the legs 15 and 16 toward oncoming traffic. Reflector tape 32 may be wrapped around the leg 16 to give visual indication of the post from the headlights of vehicles travelling along the road R. The mailboxes 13 may be of conventional metal or a molded plastic design.

Figure 4:
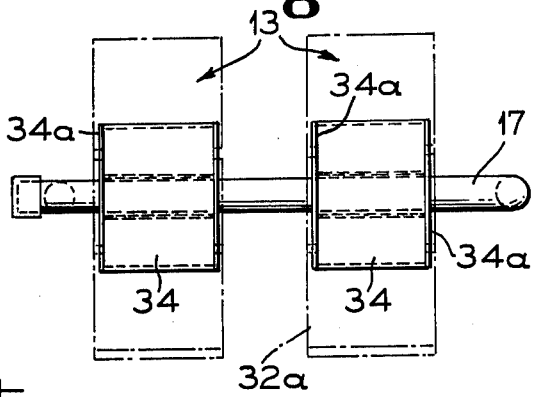
FIG. 4 is a top plan view taken along the line IV—IV of FIG. 3.
Figure 5:
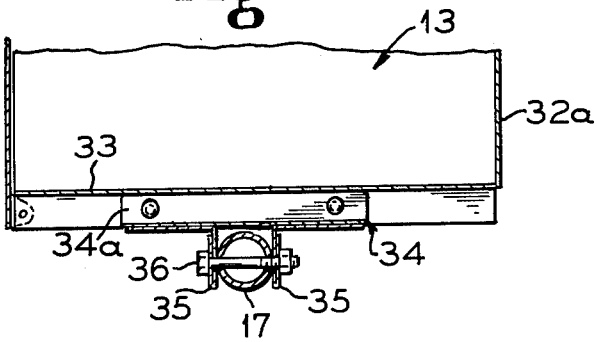
FIG. 5 is a fragmentary vertical sectional view along the line V—V of FIG. 4.

The mailbox 13 shown in FIGS. 4 and 5 are of conventional metal design with a sheet metal hood 32*a* seam folded into a bottom plate 33. To provide a secure mounting for the mailboxes which will not tear the relatively thin gauge metal for the hood 32*a* and the bottom 33, a plate 34 is mounted under the bottom 33 and has upturned sidewalls 34*a* fastened by screws or pop rivets to the inside faces of the seams joining the hood 32 and bottom 33. Bent metal strips 35 are spot welded to the bottom face of the plate 34 and have depending vertical legs or sides straddling the post leg 17 and receiving a throughbolt 36 to bolt the strips 35 to the post leg 17. As illustrated in FIG. 3, two such throughbolts 36 can be used to securely mount the mailbox on the leg 17.

Figure 6:
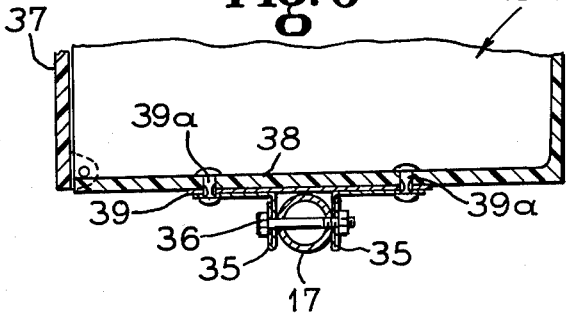
FIG. 6 is a view similar to FIG. 5 but illustrating a modified mounting arrangement.

In FIG. 6, a modified plastics material mailbox 13*a* has the hood 37 and the bottom 38 of the box molded in one piece and a metal reinforcing plate 39 is secured by shear pins 39*a* to both the bottom 38 and the strips 35 which strips straddle the post leg 17 and are bolted thereto by throughbolts 36 all as described in connection with FIGS. 4 and 5.

Shelf-like sheet metal constructions are thus provided on top of the horizontal post leg 17 to afford strong base supports for the mailboxes of any construction which can separate from the leg 17 under severe impact.

Figure 7:
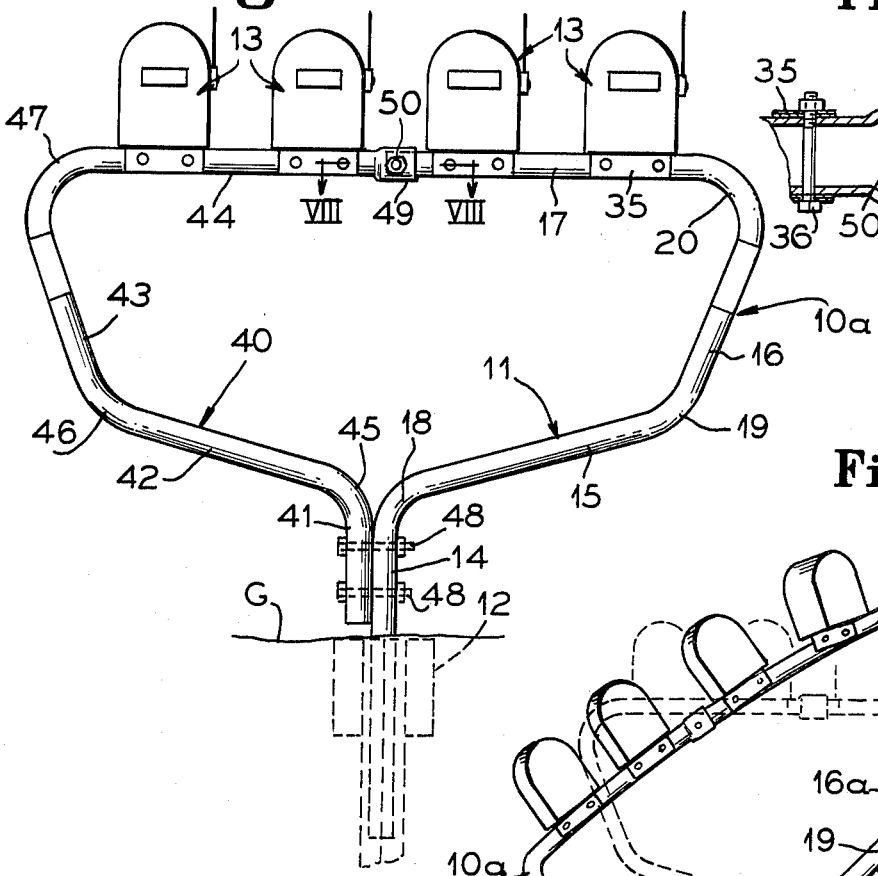
FIG. 7 is a view similar to FIG. 3 but illustrating the extended post arrangement of this invention.
Figure 8:
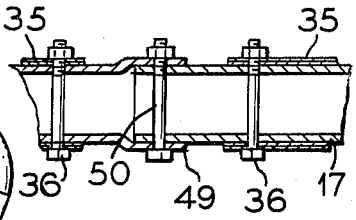
FIG. 8 is a horizontal fragmentary sectional view along the line VIII—VIII of FIG. 7.

As shown in FIG. 7, a modified embodiment 10*a* combines the main support post 11 with a complimentary auxiliary post 40 mounted thereon to lie in the same plane. This auxiliary post 40 has a short depending upstanding leg 41 paralleling the leg 14 of the main post. This leg 41 is bent outwardly to form the lateral sloping leg 42 corresponding with the leg 15 and then the upper end of the leg 42 is bent upwardly and outwardly to form the leg 43 complimenting the vertical leg 16. The upper end of the leg 43 is reversed bent to form a top horizontal leg 44 complimenting the leg 17. The bends 45, 46 and 47 merging the legs 41, 42, 43 and 44 have the same angles and radii as the bends 18, 19 and 20 merging the legs of the main post 11. The depending leg 41 of the complimentary post 40 is shorter than the leg 14 of the main post 11 and is bolted to this leg by throughbolts 48. The free end of the horizontal leg 44 of the complimentary post is enlarged at 49 to receive therein the free end of the leg 17 and a throughbolt 50 joins the free ends of the leg 17 and 44 in the same plane. The additional top leg 44 provided by the complimentary post 40 accommodates the mounting of additional mailboxes 13 thereon.

The two posts 11 and 40 provide a closed loop configuration paralleling the roadway. It will of course be appreciated that the lengths of the legs 15, 42, 17 and 44 of the two posts could be decreased or increased as desired to accommodate less or more mailboxes 13.

The modified closed loop embodiment 10*a* of the invention shown in FIG. 7 can have either the leg 16 or 43 facing the oncoming traffic.

Figure 9:
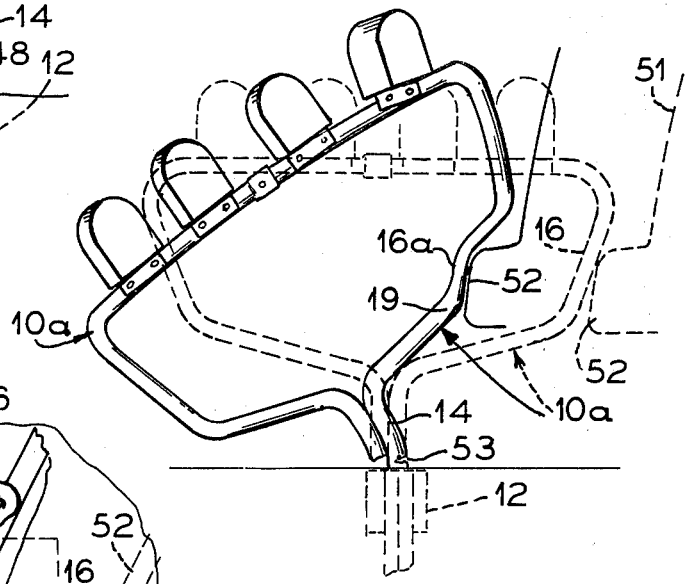
FIG. 9 is a diagrammatic front elevational illustration of the crushing and tilting of the support of this invention on impact from an oncoming vehicle.

As depicted in FIG. 9, the front end 51 of an automobile has its projecting front bumper 52 impacting the leg 16 of the closed loop modified post structure 10*a* and as the vehicle moves forward, the bumper 52 dents or crushes the leg inwardly as illustrated at 16*a* in the juncture of the bend 19. The grill of the automobile above the bumper then strikes the upper portion of this leg 16 and the entire structure is tilted in the direction of impact moving it from the dotted line to the solid line position. A weakened fracture zone in the leg 14 provided by a hole 53 or the like through the leg just above the top of the strip 24 of the anchor 12 facilitates tearing of the leg 14 permitting the structure to pivot about the torn section but retained by a bending strap portion to the anchor.

Figure 10:
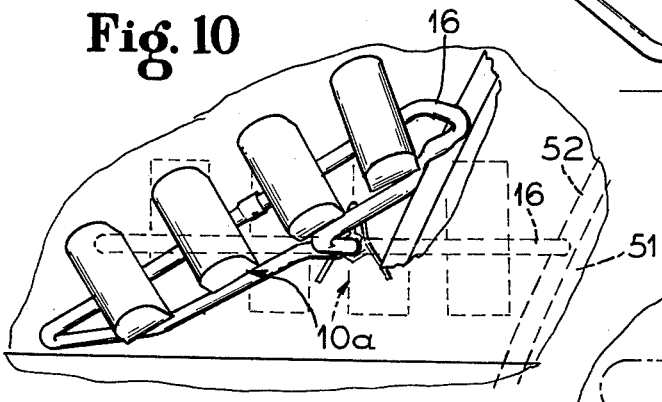
FIG. 10 is a top plan illustration of the impact shown in FIG. 9.

If, as illustrated in FIG. 10, the oncoming vehicle 51 has its bumper 52 striking the leg 16 at an angle, the structure 10*a* will also rotate from the dotted to the solid line positions. This rotation can be accommodated by permitting the leg 14 to slip in the socket of the ground anchor since the wedge clamp can be regulated to permit such rotation under heavy load.

In the event the vehicle impacts against the mailboxes 13 or 13*a* they may be sheared off of the post by breaking of the shear pin or bolt mountings and will either drop to the ground or fly over the vehicle.

Figure 11:
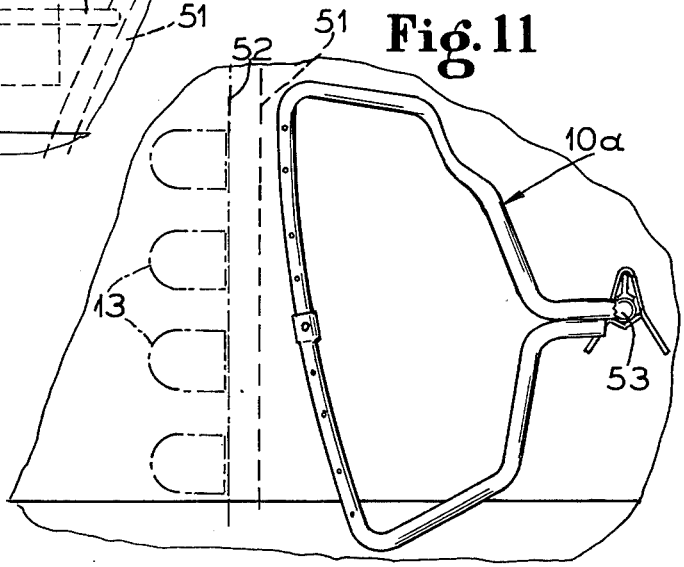
FIG. 11 is a top plan view of the support and mailboxes after completion of the impact from a vehicle showing the manner in which the structures are trapped under the vehicle.

Finally, as illustrated in FIG. 11, the structure 10*a* will be pushed to the ground and the vehicle 51 can ride over the post structure. Then if the bumper 52 breaks the mailboxes 13 off of the support structure 10*a* they will be trapped under the vehicle.

The single post embodiment 10 will function under impact in the same manner illustrated for the embodiment 10*a*.

FIGS. 9 to 11 thus illustrate how the support structures of this invention function to prevent entry of any structure into the occupied area of a vehicle crashing into the structure.

It will be understood that many departures from the illustrated embodiments of the invention may be made without departure from the scope of the invention.

I claim as my invention:

1. A support for mailboxes and the like devices mounted alongside roadways which protects the occupants of a vehicle crashing into the support which comprises a post having a depending upright leg adapted to be anchored in the ground, a generally horizontal upright sloping leg extending laterally from the top of said upright leg, an outwardly sloping substantially vertical leg extending upwardly from the upper end of said lateral leg and a top horizontal leg extending rearwardly from the top of the sloping vertical leg overlying the lateral leg in spaced superimposed relation, and a ground anchor seating the lower end of the depending upright leg and securing the support in an upright position with the sloping legs parallel to the roadway and facing oncoming traffic on the roadway.

2. A post for mounting structures alongside roadways which crushes and bends upon impact by an oncoming vehicle to protect the occupants of the vehicle which comprises a generally reverse "C" shaped post having a depending upright lower leg, an upwardly sloping lateral leg extending from the top of the upright leg, an outwardly sloping vertical leg extending from the upper outer end of the lateral leg and a top horizontal leg extending rearwardly from the upper end of the vertical leg and overlying the lateral leg in spaced vertical relation, mountings on said top horizontal leg for structures to be carried by the post, and means for anchoring the lower leg in the ground at a depth to position the sloping legs parallel to the roadway facing oncoming traffic at a height to be engaged by vehicle bumpers of the oncoming traffic for controlling a bending of the post under the vehicle.

3. A support for mailboxes and the like which comprises a tubular structure having a depending vertical leg, diammetrically opposite upwardly sloped lateral legs extending from the upper end of the vertical leg, sloping vertical legs extending upwardly and outwardly from the outer ends of the lateral legs and a top horizontal leg extending from the tops of the sloping vertical legs and spanning the space therebetween in spaced relation above the lateral legs, mailboxes supported transversely on the top horizontal leg, a ground anchor having a socket receiving the lower end of the depending leg and wedge means in the socket locking the depending leg at a desired level to position the top horizontal leg for access to the mailboxes and to position the sloping vertical legs within the range of the height of an automobile bumper, and a weakened fracture zone in said depending leg at the top of the anchor socket.

4. The support of claim 1 including a wedge lock in the ground anchor engaging the depending upright leg at a selected level to control the length of the leg projecting above the anchor and thereby controlling the height of the top horizontal leg.

5. The support of claim 1 wherein the post is composed of a hollow tube and has a fracture zone in the depending leg just above the ground anchor.

6. The support of claim 1 wherein the legs are merged through bends having a radius of from 3 to 5 inches and angles that will slope the lateral leg at about 15 to 30 degrees from the horizontal and the vertical leg about 15 to 30 degrees from the vertical.

7. The post of claim 2 wherein a bend defining an external angle of about 105 to 130 degrees merges the depending upright lower leg into the upwardly sloping lateral leg, a second bend providing an internal obtuse angle of about 105 to 130 degrees merges the lateral leg into the outwardly sloping vertical leg and a bend defining an internal acute angle of about 65 to 75 degrees merges the sloping vertical leg into the top horizontal leg.

8. The support of claim 3 wherein the tubular structure is composed of two complementary pieces secured together at the depending vertical leg and at the top horizontal leg.

9. The support of claim 8 wherein the two pieces are "C" shaped and fit together at the top horizontal leg.

10. The support of claim 3 wherein the weakened fracture zone is provided by a hole punched through the tube flush with the top of the anchor socket.

11. The support of claim 3 wherein the anchor socket has a leg driven in the ground receiving the depending vertical leg of the support thereagainst and a wedge clamping the depending vertical leg at a selected level relative to the leg of the anchor.

12. A post for mounting structures alongside roadways which crushes and bends upon impact by an oncoming vehicle to protect the occupants of the vehicle which comprises a generally reverse "C" shaped post having a depending upright lower leg, an upwardly sloping lateral leg extending from the top of the upright leg, an outwardly sloping vertical leg extending from the upper outer end of the lateral leg and a top horizontal leg extending rearwardly from the upper end of the vertical leg and overlying the lateral leg in spaced vertical relation, a complimentary "C" shaped post connected to said lower leg and said top horizontal leg of the reverse "C" shaped post to provide a closed loop configuration with an extended top horizontal leg, and mountings on said top horizontal legs of the reverse "C" shaped post and the complimentary "C" shaped post for structures to be carried thereby.

* * * * *